US009828736B2

(12) United States Patent
Doolaege

(10) Patent No.: US 9,828,736 B2
(45) Date of Patent: Nov. 28, 2017

(54) WATER CONTAINMENT STRUCTURE WITH FINGER ENDS

(71) Applicant: David Doolaege, Carlotta, CA (US)

(72) Inventor: David Doolaege, Carlotta, CA (US)

( * ) Notice: Subject to any disclaimer, the term of this patent is extended or adjusted under 35 U.S.C. 154(b) by 0 days.

(21) Appl. No.: 15/047,209

(22) Filed: Feb. 18, 2016

(65) Prior Publication Data

US 2017/0241092 A1 Aug. 24, 2017

(51) Int. Cl.

| | |
|---|---|
| ***E02B 7/00*** | (2006.01) |
| ***E02B 7/20*** | (2006.01) |
| ***E02B 7/50*** | (2006.01) |
| ***E02B 3/10*** | (2006.01) |

(52) U.S. Cl.
CPC ..... *E02B 3/108* (2013.01)

(58) Field of Classification Search
CPC ... E02B 3/10; E02B 8/06; E02B 3/108; E02B 7/14; E02B 3/16; E02B 7/00; E02B 7/005; E02B 7/04; E02B 7/06
USPC ..... 405/101–117; 383/105–120
See application file for complete search history.

(56) References Cited

U.S. PATENT DOCUMENTS 2,616,467 A * 11/1952 Cicero ..... B65D 33/28 383/16
2,669,272 A * 2/1954 Permann ..... B62D 49/085 224/572
2,687,158 A * 8/1954 Owen ..... B65D 75/5877 206/521
3,191,386 A * 6/1965 Wiegel ..... E02B 3/06 405/115
3,246,474 A * 4/1966 Mesnager ..... E02B 7/005 405/115
3,373,568 A * 3/1968 Hornbostel, Jr. ..... E02B 3/04 405/115
3,886,751 A * 6/1975 Porraz Jimenez Labora ..... B28B 7/065 383/32
3,922,832 A * 12/1975 Dicker ..... C04B 40/0608 405/107
3,928,980 A * 12/1975 Ganzinotti ..... E02B 7/005 405/110
3,957,098 A * 5/1976 Hepworth ..... B65D 33/00 383/44
4,362,433 A * 12/1982 Wagner ..... E01F 13/02 405/107

(Continued)

*Primary Examiner* — Matthew R Buck
*Assistant Examiner* — Edwin Toledo-Duran
(74) *Attorney, Agent, or Firm* — M. Reid Russell

(57) ABSTRACT

A water containment structure that includes at least one flexible sleeve formed from a strong flexible material that will resist puncturing and is formed to contain at least one bladder formed to retain water, and which said sleeve includes center notches formed in the opposite sleeve ends that separate like closed end parallel fingers, which bladder fills the sleeve to the sleeve finger ends so that the bladder ends fit into and against the finger ends, and at least one water fill and drain tube fitted through said sleeve intro said bladder to pass, respectively, water into, and drain water from which bladder, and said bladder includes an air drain to provide for evacuating air from the sleeve during bladder filling. Which sleeve finger ends can be fastened together around a support, and which sleeve finger ends and notches can be secured to one another for connecting a number of sleeves, end to end, into a water containing structure.

10 Claims, 6 Drawing Sheets

(56) References Cited

U.S. PATENT DOCUMENTS 4,573,508 A * 3/1986 Knaus ..... B65D 88/16 220/562
4,887,541 A * 12/1989 Rodemann ..... B63B 43/12 114/68
4,887,700 A * 12/1989 Rice ..... A45C 3/004 190/111
5,059,065 A * 10/1991 Doolaege ..... E02B 7/005 405/107
5,125,767 A * 6/1992 Dooleage ..... E02B 3/108 405/114
5,743,674 A * 4/1998 Healy ..... E02B 3/108 210/321.73
5,803,333 A * 9/1998 Fawcett ..... A45F 3/00 224/148.2
5,820,297 A * 10/1998 Middleton ..... E02D 31/00 405/107
5,865,564 A * 2/1999 Miller ..... E02B 3/108 405/114
5,885,564 A * 3/1999 Zastrow ..... A61K 8/22 424/195.16
5,996,799 A * 12/1999 Garreth ..... B65D 33/24 206/521
6,022,172 A * 2/2000 Siyaj ..... E02B 3/108 405/110
6,186,701 B1 * 2/2001 Kempers ..... E02B 3/127 383/105
6,364,571 B1 * 4/2002 Doolaege ..... E01D 15/20 405/114
6,481,928 B1 * 11/2002 Doolaege ..... E01D 15/20 138/98
6,619,884 B2 * 9/2003 Davis ..... E01F 15/086 405/111
6,641,329 B1 * 11/2003 Clement ..... E02B 3/108 405/115
6,675,998 B2 * 1/2004 Forsman ..... A45F 3/20 215/306
6,679,654 B1 * 1/2004 Wittenberg ..... E02B 3/108 256/13
6,715,960 B2 * 4/2004 Metz ..... E02B 3/108 405/111
6,739,274 B2 * 5/2004 Eagles ..... B63B 35/285 114/256
6,783,300 B2 * 8/2004 Doolaege ..... E02B 3/108 405/115
6,905,289 B1 * 6/2005 Sanguinetti ..... E02B 3/108 405/107
7,762,742 B1 * 7/2010 Smith ..... E02B 3/108 405/114
8,939,681 B2 * 1/2015 Pienaar ..... E02B 3/127 383/120
2002/0081153 A1 * 6/2002 Genzel ..... E02B 3/108 405/114
2004/0146359 A1 * 7/2004 Doolaege ..... E02B 3/108 405/115
2005/0260038 A1 * 11/2005 Sousa Costa ..... E02B 3/127 405/115
2007/0053752 A1 * 3/2007 Kim ..... E02B 3/12 405/284
2007/0243021 A1 * 10/2007 Tyler ..... E02B 3/108 405/114
2008/0138157 A1 * 6/2008 Kim ..... E02D 29/0291 405/107
2010/0014788 A1 * 1/2010 Powell ..... E02B 3/127 383/107

* cited by examiner

WATER CONTAINMENT STRUCTURE WITH FINGER ENDS

BACKGROUND OF THE INVENTION

Field of the Invention

This invention relates to structures for filling with water for damming water courses, controlling and directing water flow, for damming between walls and support structures, and providing for end to end connection of structures to extend across an area to be dammed, and the like, and includes sleeves for containing water containing bladders, where the damming structure is inexpensive to construct, erect, and dismantle.

Prior Art

A need for easily installable and versatile damming structures, and the like, particularly structures that are filled with water, that are relatively inexpensive, non-permanent, reusable and are durable have been recognized by the inventor who has been awarded a number of U.S. Patents for forming and joining water structures together, forming hydraulic damming structures Such water structures have been found to be very useful for safely and reliably containing water, for directing water, are also useful for controlling hazardous waste, oil or chemical spills, for flood control, and the like. Further, such water structures are also useful, for example, for temporary damming operations such as may be involved in agricultural water storage, construction, for de-watering work sites and fields, to protect buildings against flooding, and the like, and are even appropriate for use as permanent or long term structures.

Heretofore it has been recognized that fluid filled flexible water control structures and barriers can, if formed to resist movement, be used for retention and storage of water, control of water flow and wave action, and a number of configurations of dams and barriers have been arranged as both semi-permanent and temporary structures. Such earlier patents, however, do not show a combination of a flexible sleeve that is configured with finger ends, where the sleeves can be fitted and maintained together to form a continuous damming structure, or where the finger ends can be fitted into a door way or against a wall end to span that door way or wall. In practice, with the filling of a bladder or bladders within the sleeve or sleeves, a secure dam is formed across an area to be de-watered, across a door way, or to extend outwardly from a wall end.

Where earlier continuous damming sleeve and bladder structures have been arranged across an area to be dammed or de-watered, such have generally included pairs of sleeve with bladders that are braced against a pier structure, or have employed an outer sleeve to discourage the individual sleeves and filled bladders from rolling apart responsive to the weight of water or wave action directed against the damming structure, or have utilized other arrangements for keeping the sleeves with water filled bladders from moving. Unique to the invention, the sleeve fingers can be joined together, as by lacing them together along common edges, to discourage sleeve movement, can be joined around a fixed pole, or the like.

Summarizing, before the invention, no prior art structure has provided a barrier arrangement or arrangements of barriers were the sleeve ends have fingers can function, as set out above, to provide a versatile damming structure to meet a variety of needs as the invention can be used for.

SUMMARY OF THE INVENTION

It is a principal object of the present invention to provide a damming structure that includes at least one flexible sleeve for containing a bladder or bladders for filling with water, where each bladder includes a filling arrangement and an air drain, where the sleeve ends are notched, forming a U shape that the bladder or bladder ends fit into, with the sleeve notches to fit along opposite sides of the edge of a doorway or wall, providing, with the bladder or bladders filled with water, a barrier across a doorway or extending outwardly from a wall, and which sleeve notched ends can be fitted and maintained together, in end to end relationship, forming a barrier across an area to be de-watered or protected from flood waters.

Another object of the present invention is to provide the sleeve ends from the notches with flat parallel top and bottom surfaces or can have a taper in the top from adjacent to, or forward from, the notch, to the finger end to facilitate positioning of the sleeve finger ends containing the bladder ends across a door way or wall, and for, with blunt sleeve finger ends fitted together, will provide approximately a uniform height or the dam across the notches junction.

Another object of the present invention is to provide sleeves having ends that, from the notch, can be fitted around or across a fixed structure such as a door way, wall, post, or the like, where the sleeve notch fingers can be joined, as by lacing through spaced holes formed along the fingers edges to fix the sleeve ends in place, whereafter the bladders in the sleeve are filled with water to provide a barrier to water.

Still another object of the present invention is to provide for; conveniently filling each bladder with water to erect the structure as a water barrier; venting air from between the bladder and sleeve during filling; and for conveniently draining which bladder to deflate the barrier when it is no longer needed.

Still another object of the present invention is to provide a portable damming structure that is easily transported and erected to protect a building against flooding; to prohibit flooding of an area or for de-watering a flooded area, that is easily deflated and removed after the flood danger has subsided.

Principal features of the invention include at least one sleeve that is formed from a strong, woven polypropylene material, such as GeoTex®, or like material, to provide that is puncture resistant and has a tear strength that is sufficient to maintaining the forces exerted thereon when functioning as a damming structure, and the sleeve is to receive at least one bladder preferably formed from a lightweight polyethylene material that is capable of be filled with water to its capacity without rupturing, that includes a filing tube and air drain, and which sleeve includes a notched section in each end, between fingers, forming a U shape. Where the fingers extend parallel and each receives a bladder end fitted therein to receive water, forming a damming structure, and provides for venting air from the finger ends during bladder filling. In practice the sleeve notched ends can each be fitted across opposite sides of a pair of wall ends or sides of a door opening, straddling that wall end or door way. So arranged, the sleeve bladder or bladders, when filled with water, provide a damming structure between the wall ends or across the doorway that prohibits flood waters from passing thereacross.

The fingers top surface may be sloped relative to the finger bottom surface from the notch to the finger ends for fitting the finger along opposite sides of a doorway or wall sides, or may not be sloped, having blunt ends where the ends are essentially at right angles to the finger top and bottom surfaces, allowing the sleeve to be positioned together at their notches, with the fingers positioned alongside one another and can be joined together, as by lacing through holes, that are preferably reinforced, forming grommets, where the holes are formed at spaced interval along the fingers edges, whereby the height of the joined sleeves at the junction will be essentially the same height as that of the filled sleeves. Additionally, the fingers ends can be joined around a pier or post and secured together, as by lacing, with the pier or post therebetween, providing an anchor for holding the sleeves in place.

In practice a strong flexible sleeve formed from Geo-Tex®, a material manufactured by Propex Operating Company, LLC, and bladder formed from a lightweight polyethylene plastic, or the like, is selected to provide a bladder that, when filled with water, is strong enough to resist punctures and the bladder ends that fit into the sleeve finger ends preferably has a wall thickness of from (5) to (12) millimeters has been used successfully for installation in the fabric sleeve of the invention. Though, it should be understood, the invention is not limited to any particular sleeve or bladder manufacture or thickness; can utilize sleeves and/or bladders of greater or lesser wall thickness; and the sleeve notch ends can be connected by lacing a cable through grommets, or by other connection arrangement, for maintaining the sleeves fingers together, within the scope of this disclosure.

DESCRIPTION OF THE DRAWINGS

In the drawings which illustrate that which is presently regarded as the best mode for carrying out the invention.

DETAILED DESCRIPTION OF THE INVENTION

Temporary water structures that are erected at a location to be de-watered, to protect an area or structure from anticipated flooding, and are in common use. Such temporary structures have included flexible sleeves containing bladders or closed end tubes for positioning at a site to be dammed, with the bladders then filled with water to erect the damming structure. Such water structures have, however, lacked versatility in that none have provided convenient arrangements for joining sleeves together in an end to end relationship. Further, earlier temporary water structures have needed to included at least an arrangement of two bladders in a single sleeve along with an anchoring structure to provide a dam that would resist side ways movement or rolling from water forces exerted onto one side of the sleeve, or have required that a pair of sleeves with tubes or bladders in each that have then been contained in an outer sleeve to resist rolling movement where lateral forces were exerted against the dam. Whereas, the invention provides a sleeve with U shaped notch ends, forming parallel fingers, where the fingers can be sloped to fit and be conveniently maintained across a door way or wall end, where the fingers can be joined together around a post, or the like, for holding the sleeve, or a plurality of sleeve having blunt ends that are approximately the height of the sleeve body can be joined end to end by fitting sleeve fingers together to their notched ends to form a damming structure that will resist movement.

Figure 1:
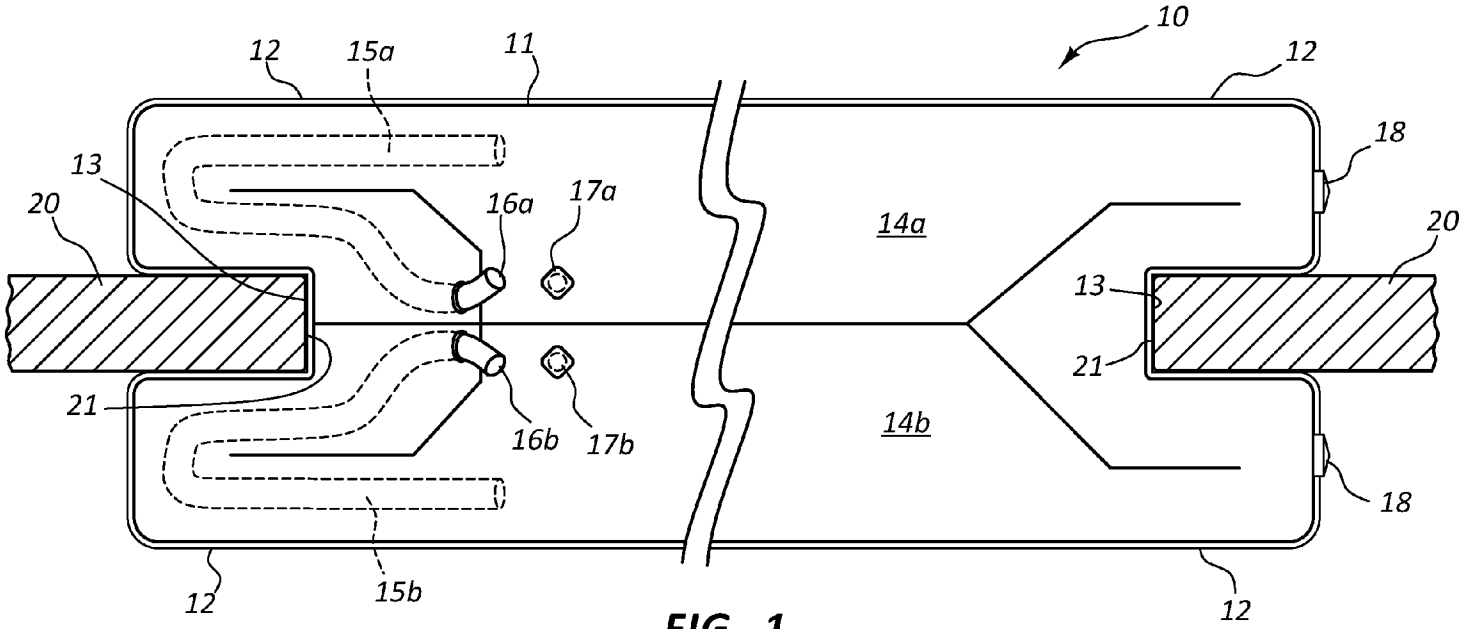
FIG. 1 is a top plan view of a water containment structure with finger ends of the invention that is shown as a sleeve with end notches forming like fingers that can be fitted across a wall or doorway, and showing the sleeve as containing a pair of bladders or closed end tubes whose ends are fitted into the finger ends and showing, in broken lines each bladder or closed end tube as including a fill tube and air drain that extend out from each bladder or tube.

FIG. 1 shows a top plan view of a water containment structure with finger ends 10 of the invention, hereinafter referred to as damming structure. Shown therein, the damming structure 10 includes a sleeve 11 having parallel fingers 12 with a notch 13 there between formed on opposite sleeve ends. The sleeve 11 is shown as including a pair of bladders 14*a* and 14*a* that, it should be understood, can be tubes that are closed at their ends. Which bladders 14*a* and 14*b* extend the length of the sleeve, in parallel relationship, and into, the finger ends 13. Each bladder 14*a* and 14*b* includes a fill tube 15*a* and 15*b*, that has a nozzle end 16*a* and 16*b* that extends out of the sleeve for filling the individual bladders with water, and each bladder 14*a* and 14*b* includes an air drain 17*a* and 17*b* that extends from the bladder and extends through the sleeve to vent air from the bladder as it is filled with water. Where a pair of bladders

14*a* and 14*b* is shown, it should be understood that a single bladder, formed to fit within the sleeve 11 and into the fingers 12, that includes a fill tube and air vent could be used in the invention within the scope of this disclosure. Additionally, air vents 18 are provided in the end of each sleeve finger of at least one end of the sleeve to facilitate venting air from the sleeve ahead of the bladder when the bladder is being filled with water through the fill tube, which air vents allow the bladder to fully fill the sleeve and sleeve finger ends.

Figure 3:
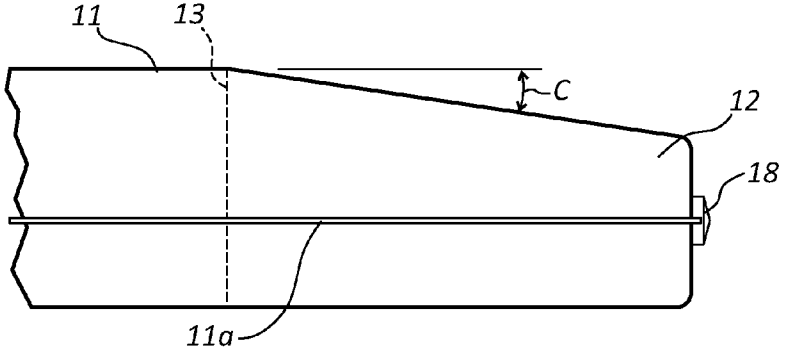
FIG. 3 shows a side elevation view of the sleeve of FIG. 2, showing the slope of one of the sleeve slanted finger ends as angle C, with the other sleeve finger ends being identical thereto, and showing, in broken lines, the end of the sleeve notch.
Figure 2:
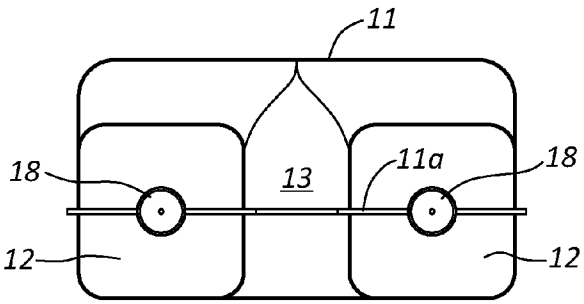
FIG. 2 is an end view of the sleeve and with finger ends, less the wall or doorway, showing the sleeve seam that extends around the sleeve mid-section, showing the seam formed from upper and lower sections joined at a seam, and showing the finger ends as including a pair of air vents.

FIG. 1 shows the damming structure 10 fingers 12 fitted across an end of a structure 20, with the sleeve notch 13 in engagement with the structure end 20. This arrangement of the damming structure 10 illustrates it's use to protect an area across the structure ends 20 that can be a door way, an area behind two walls, or the like. To facilitate fitting which fingers 12 across a door way or between wall ends, as shown in FIGS. 2 and 3, the fingers 12 are slopped at like slants from adjacent to or just forward of the notch 13 to each finger 12 end. Which slope is shown as angle C in FIG. 3, and, it should be understood, can vary depending upon the use as the damming structure 10 is use for. In practice, for fitting the sleeve fingers across a doorway or wall end, such slope is selected from where the finger top and bottom surfaces are nearly parallel for, for joining the sleeve ends together to form a continuous damming structure, the ends of the fingers will be essentially at right angles to the finger top and bottom surfaces and, accordingly, the slope angle C can be from essentially (0) zero to (90) degrees, within the scope of this disclosure. Such finger slant facilitates the fitting of the fingers across the door way or wall end to the notch 13 where the fingers 12 extend along the opposite sides of the doorway or wall ends 20, is selected to provide a narrowing area within the bladder 14*a* and 14*b* fitted into the finger ends 12 while allowing for and encouraging the exhausting of air from the space in-between which bladder outer surface and fingers inner surfaces that is vented out from the air vents 18.

Figure 4:
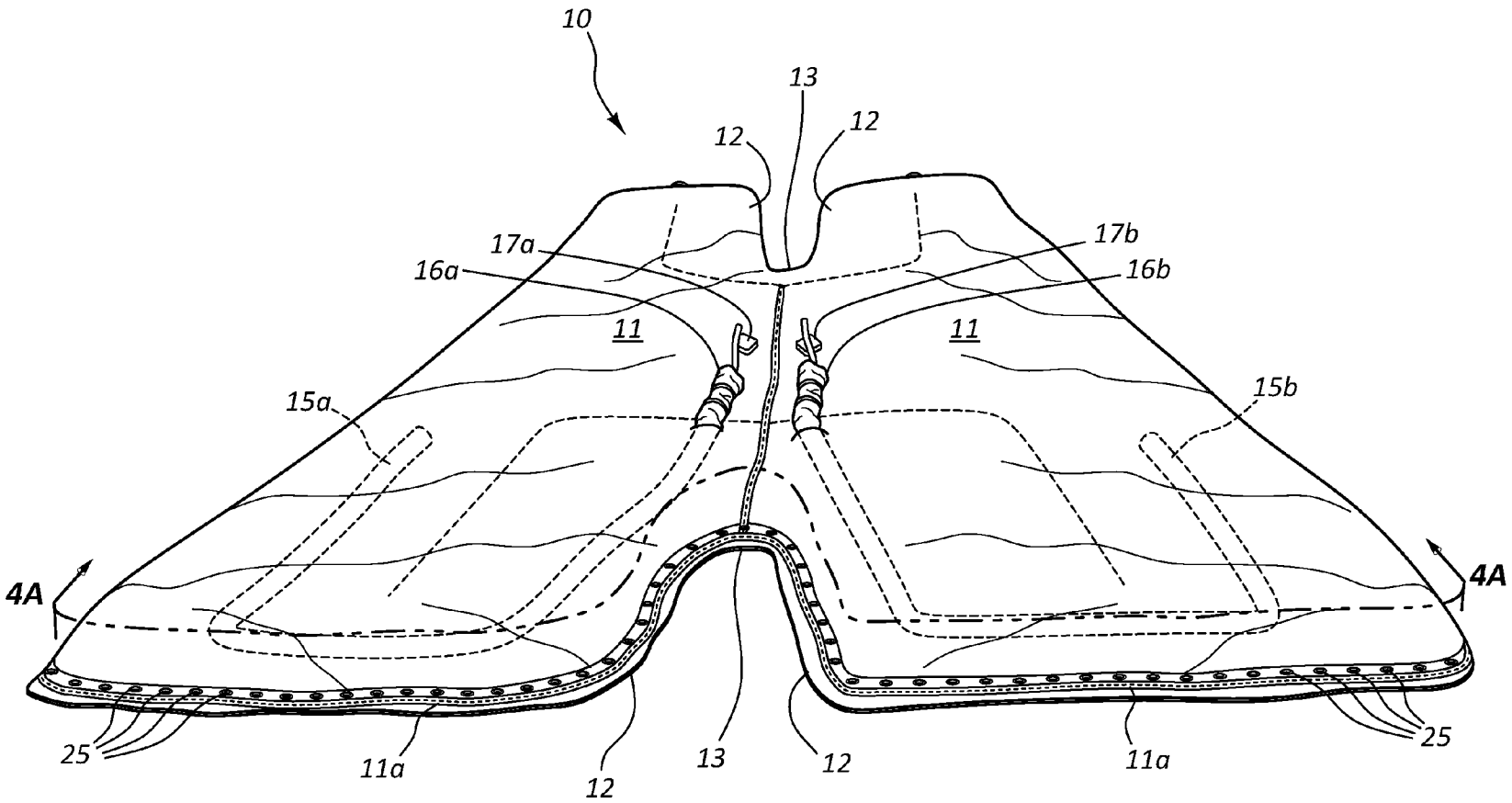
FIG. 4 is an end perspective view of the sleeve showing the sleeve as formed from top and bottom sections of material that are secured together, as by stitching the edges of the sections together, showing the bladders in broken lines, and showing in broken lines, a pair of fill tubes for filling the bladders with water, with the fill ends thereof shown as extending out from the sleeve, and showing bladders air vents adjacent to the fill tubes ends, and showing the pair of finger ends air vents, as are shown also in FIGS. 1, 2 and 3.
Figure 8:
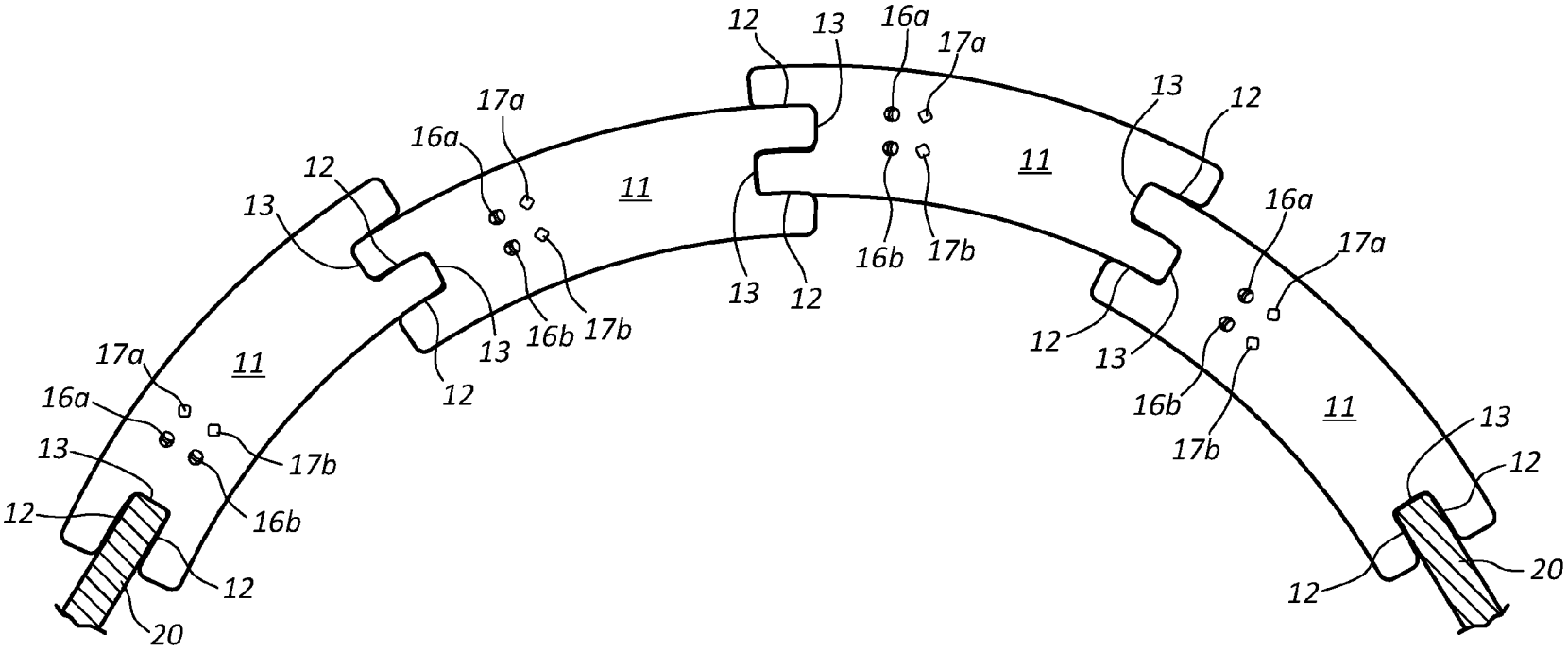
FIG. 8 shows a damming structure like that of FIG. 7, except the damming structure is shown formed into an arc.

Also shown in FIGS. 2 and 3, the sleeve 11 is preferably formed from a pair of like sections of sleeve material which, in practice, that is preferably a strong, woven polypropylene geotextile type material that provides strength and is puncture resistance, and a GeoTex® flexible fabric material manufactured by Porpex Operating Company, LLC that is resistive to tearing even when it is pulled over rough terrain, has been used as the damming structure 10. Though, it should be understood, other materials may be so utilized within the scope of this disclosure. In practice, the sections of material are formed as upper and lower sections that are laid out over one another and are secured together along their common edges 11*a*, as shown in FIGS. 4 and 5, as by sewing, riveting, welding, or by other appropriate method, and spaced holes 25 are shown formed along the edges at the edges 11*a* of the sleeve 11*a* ends, as shown also in FIG. 4A. Which holes are preferably strengthened against tearing by fitted each with a metal ring, or the like, forming a grommet, and a rope, cable, lace 25*a*, or the like, is fitted through a first hole 25 and is laced through the adjacent aligned holes 25 for releasably joining the finger 12 ends together, as illustrated in FIGS. 6 and 8, as discussed below. Before or during which manufacture, the bladders 14*a* and 14*b*, that are preferably formed from a lightweight polyethylene mater, or like material, that are arranged in the sleeve 11 prior to closure of the sections of the sleeve material along common edges 11*a*. In practice, a polyethylene material that has a thickness of from five (5) to twelve (12) millimeters has been used as the bladders 14*a* and 14*b*. Which bladders thickness is selected for the liner size as is required to fill the sleeve 11.

During the forming of the sleeve 11 of the damming structure 10, as shown in FIG. 4, the bladder fill tubes 15*a* and 15*b* are installed into the bladder 14*a* and 14*b* and the fill tubes nozzle ends 16*a* and 16*b* are passed through the sleeve 11, as the bladder air drains 17*a* and 17*b* that are fitted into the bladder 11 and mounted to the sleeve 11 completing the manufacture of the damming structure 10, that can be moved to a site and filled with water.

Figure 4A:
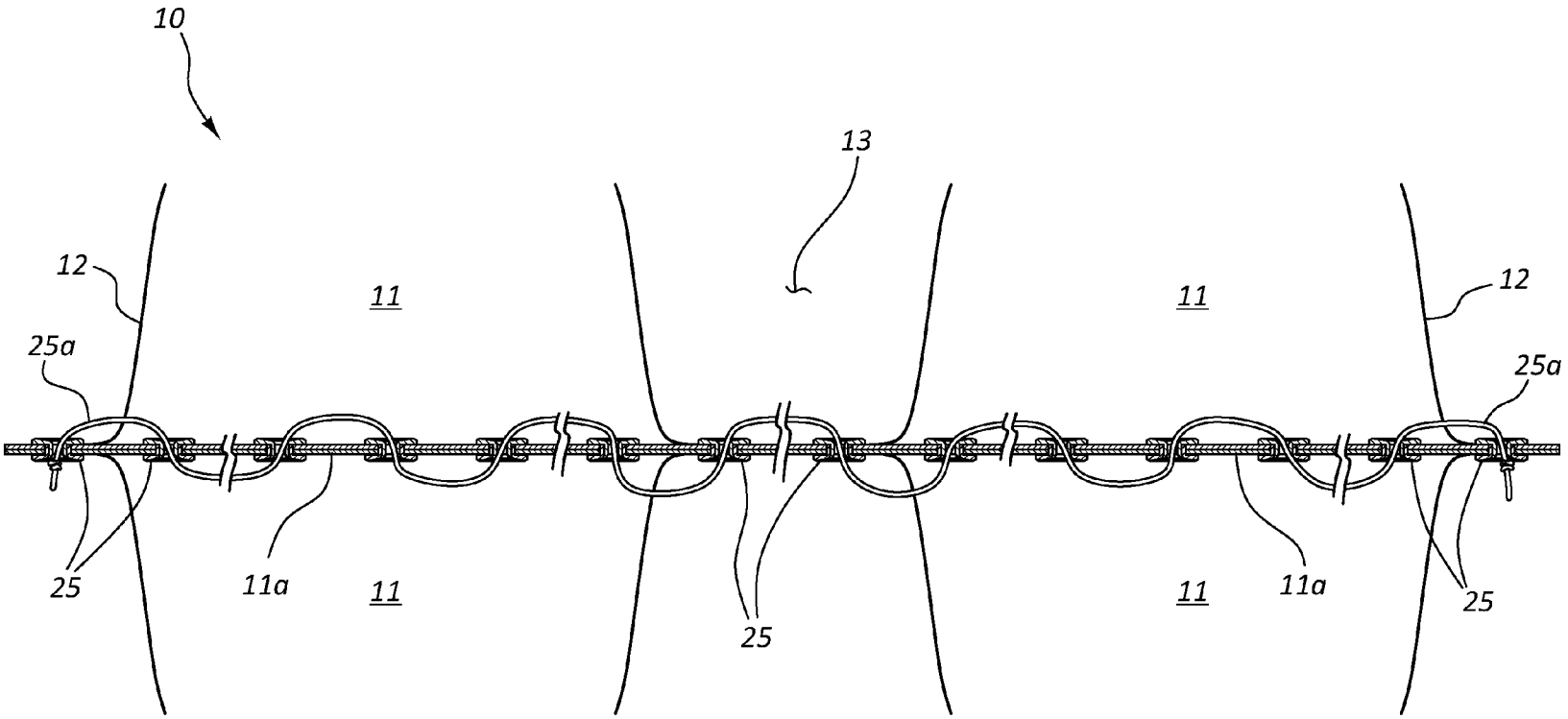
FIG. 4A is an exploded end sectional perspective view taken from a notched end of the sleeve that shows aligned spaced eyelets that have metal rings fitted therein, forming grommets, formed along the edge of each sleeve fingers and notch and shows a cable threaded through the spaced eyelets for lacing the finger ends together forming a damming structure like that is shown in FIGS. 6 and 8.
Figure 5:
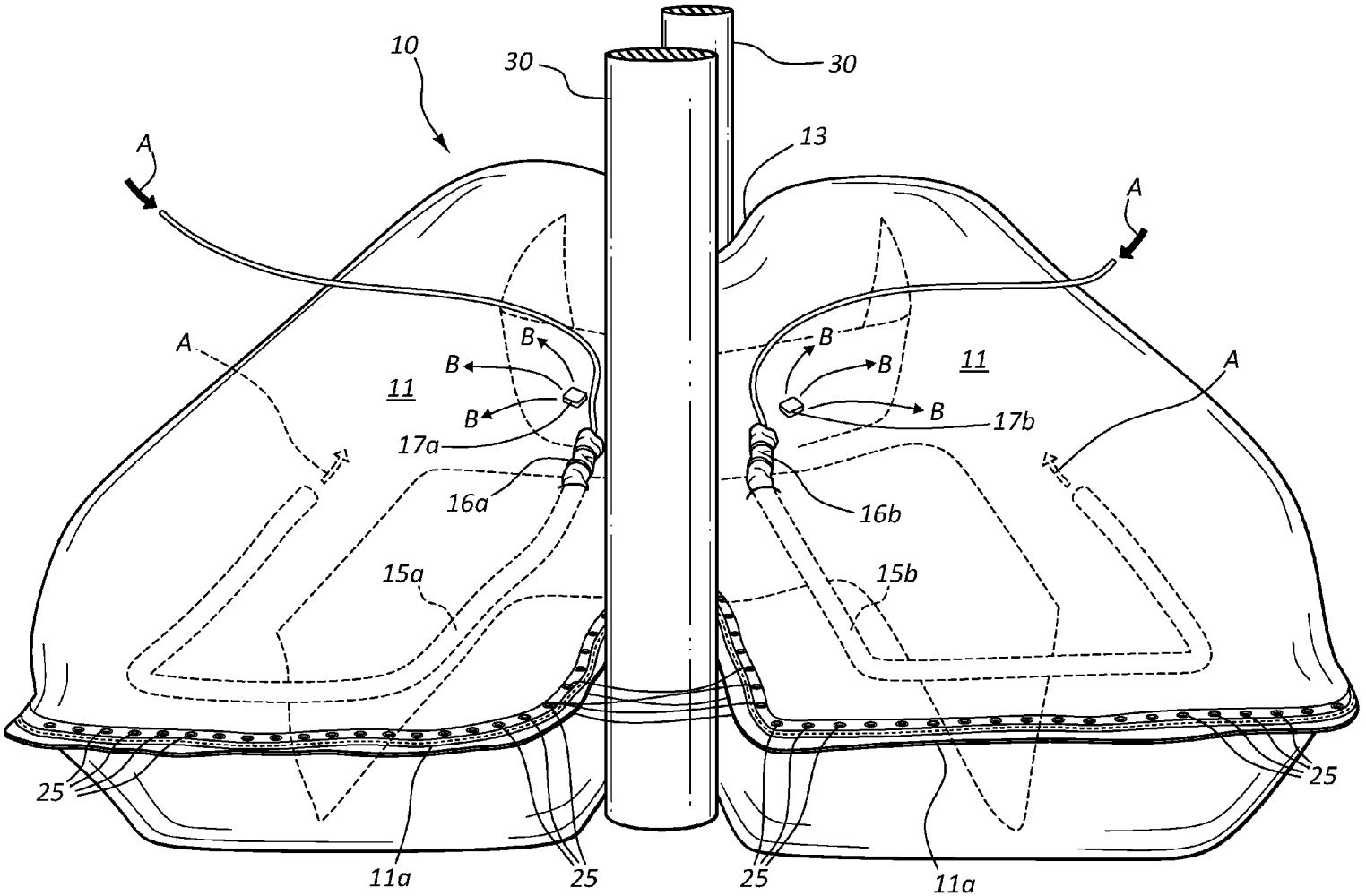
FIG. 5 is a view like that of FIG. 4 only showing the sleeve notches as positioned between vertical posts, and the bladders as having been filled with water, and illustrating which filling of the bladders with water with water by arrows A, and illustrating, with arrows B, the venting of air from the bladders through the air drains during which water filling.
Figure 6:
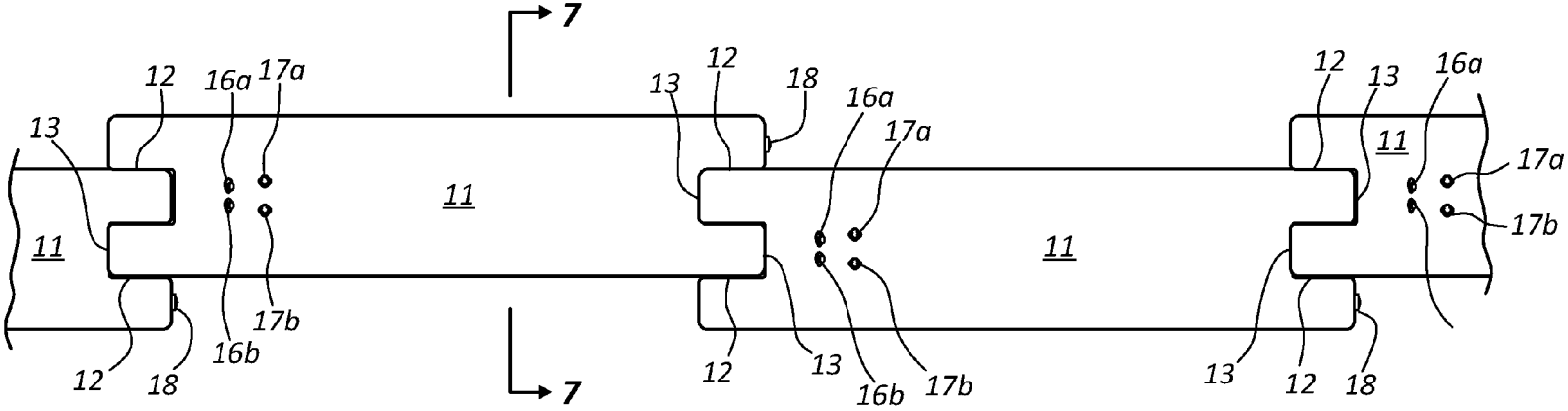
FIG. 6 shows sleeves like those of FIGS. 1 through 5, except, it should be understood, the fingers have blunt ends, and are connected end to end at their notched ends with the adjacent sleeve fingers shown connected together along common edges, forming a continuous damming structure.
Figure 7:
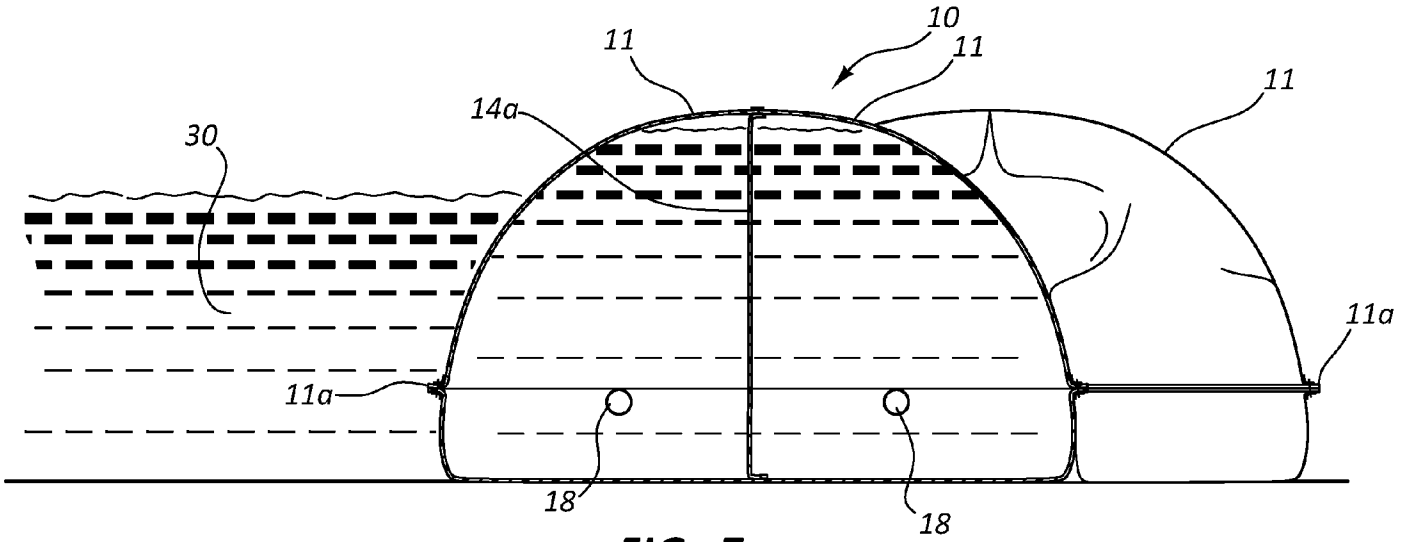
FIG. 7 shows an end sectional view taken along the line 7-7 of FIG. 6 showing the damming structure of FIG. 6 as holding back a weight of water on one side, and shows an adjacent section of the damming structure of FIG. 6.

FIG. 4A shows the end edges 11*a* of the sleeve 11 that, as shown in FIGS. 1, 4 and 5, that has been joined together and shows spaced holes 25 that, preferably have each been fitted with a reinforcing ring, forming a grommet, and shows the lace 25*a* laced through holes 25 on one side of the sleeve 11 end for connecting, end to end, finger 12 ends of sleeves, as shown in FIGS. 6 and 8, or connecting the finger 12 ends around an anchor, as shown in FIG. 5. The edges 11*a* of the sleeve 11 ends are shown in FIG. 5 positioned around poles 30, and the bladders 14*a* and 14*b* are shown as having been filled with water, forming an erected damming structure 10 supported between which poles 30. To further anchor the damming structure of FIG. 5, the ends of fingers 12 of each sleeve 11 end can be wrapped around each pole 30 such that and the sleeve 11 edges 11*a* come together and the spaced holes 25 align to receive the lace 25*a* laced through the spaced holes 25 to maintain the fingers 12 ends together, locking the sleeve ends together, FIG. 6 shows a linking, end to end, of a plurality of sleeves 11 to form damming structure 10 that extends across an area to be dammed, as for de-watering, or the like. Which arrangement of sleeves involves fitting a sleeve 11 finger end 12 of one sleeve to a notch 13 of a next sleeve 11 such that the fingers 12 of the two sleeves 11 fit side by side and their edges 11*a* over lapping to align the individual spaced holes 25, as illustrated in FIG. 4A, to receive a lace 25*a* that is laced through each pair of aligned holes 25, across along a first and second finger 12 sides, across a finger 12 end, across a notch 13, and along the first and second finger 12 sides and shows the lace ends knotted to prohibit back passage through the holes 25, securing the coupling of the sleeves 11 ends together that then receive water through fill tubes to fill the sleeves, forming damming structure 10, as shown in the sectional view of FIG. 7. Which sectional view of FIG. 7 shows a cross sectional view of one sleeve 11 with a pair of water bladders 14*a* and 14*b* therein, and shows the outer surface of an adjacent sleeve 11 as having also been filled with water, forming the damming structure 10 that, as shown, is holding back a level of water 30, which sleeves 11 and fingers 12, it should be understood, have a same height to provide, when joined end to end, a constant height of damming structure 10.

FIG. 8 also shows a damming structure 10 formed with sleeves 11 fitted together, end to end, where, like the damming structure 10 of FIG. 6, the finger ends 12 and notches 13 are connected together, only, the damming structure of FIG. 8 is shown arranged in an arc and is maintained between wall ends 20, like the single sleeve 11 arrangement shown in FIG. 1. Which damming structure 10 arrangements of FIGS. 1, 6 and 8, illustrate the variety of applications the sleeve 11 with fingers 12 and notch 13 ends can be used for to form damming structures. In forming which damming structures 10 shown in FIGS. 6 and 8, the slope of the fingers 12 top surface from approximately the notch 13 to the finger 12 end of each finger, when the fingers are positioned side by side provides, a damming structure whose profile is essentially uniform along its length, as shown in FIGS. 6 and 8.

While not shown, it should be understood that the sections of material forming sleeve 11 could be secured together along their junctions as with a zipper, or the like, to allow access to the bladders 14*a* and 14*a*, and that, within the scope of this disclosure, a single bladder or closed tube can be formed to have ends arranged to fit into the sleeve fingers 12, to the ends thereof.

The water structures 10, as illustrated in FIGS. 1 and 5 through 8, represent damming structures that will, when erected, hold back a body of or flow of water. In holding back such body of water, as when the wind passes over such body of water, wave actions may be created that tend to move the damming structure. Earlier temporary damming structures have met this problem by containing two or three water filled vessels within an outer sleeve to discourage a wave action from causing rolling the damming structure, and other arrangement have utilized anchors, or the like. The invention, as set out above, by connecting the sleeve finger ends across or around a fixed structure, as illustrated in FIGS. 1 and 5, provides for fitting and securing sleeve finger ends around an anchoring for prohibiting movement, and provides for joining of one sleeve finger ends into the finger ends of a second sleeve, such that the outside surface of the finger end is apart from the sleeve, to function like an outrigger, discouraging rolling of the damming structure 10 that extends across a section of land to be protected or de-watered, as shown in FIG. 6, and shows, in FIG. 8, such damming structure 10 as having been anchored between fixed walls, also discouraging the damming structure from moving or rolling even when the damming structure holds back a level of water that is being subjected to wind forces.

The invention is a use of a sleeve or sleeves formed of a strong, puncture resistive and durable material such as GeoTex® manufactures by Propex Operating Company, LLC, has been used in practice, through, it should be understood another like material could be so used within the scope of this disclosure. The sleeve or sleeves are to receive one or more bladders or tube or tubes whose ends have been closed to receive water filling the bladder or closed tube are preferably formed from a material, such as a flexible polyethylene plastic, that is strong enough to resist punctures and has a range of wall thicknesses of five (5) to twelve (12) millimeters, through, it should be understood bladders or tubes having greater or less thickness could be used within the scope of this invention depending upon the sleeve size, and it should, therefore, be understood, the invention is not limited to any particular sleeve material or bladder of close tube material or to a particular wall thickness of sleeve material or bladder or closed tube and that other appropriate sleeve materials or bladder or close tubes can be used within the scope of this disclosure.

Although preferred embodiments of the invention have been shown and described herein, it should be understood that the present disclosure is made by way of example only and that variations are possible, within the scope of this disclosure, without departing from the subject matter coming within the scope of the following claims and reasonable equivalency thereof, which claims I regard as my invention.

I claim:

1. A water containment structure comprising: a sleeve that is formed from a lightweight puncture resistant flexible material that is closed at opposite ends, and each of said sleeve opposite ends includes a U-shaped notch between a pair of fingers that extend outwardly from opposite sides of each U-shaped notch that are parallel to one another, and each of said fingers has a closed end; a flexible bladder that is strong enough to resist punctures is formed to fit within said sleeve and said sleeve fingers; a fill tube with a nozzle end fitted through said sleeve and sealed through said flexible bladder to pass water into and drain water out from said flexible bladder; bladder air drains arranged through a top surface of said flexible bladder that are to vent air out from beneath said top surface of said flexible bladder during filling with water, and to close when a level of water in said flexible bladder reaches said bladder air drains; and each of said sleeve fingers have air vents fitted through said fingers closed ends for venting air during filling of said flexible bladder with water; and lace means for joining said sleeve with a plurality of additional sleeves together in end to end relationship, connecting said sleeve opposite ends, said fingers and said notches of said sleeve with another sleeve of the plurality of additional sleeves together thereby forming a continuous water containment structure, the lace means consists of a flexible lace that is threaded through aligned holes formed through aligned edges of said sleeves fingers and notches and provides for connecting the ends of said flexible lace together.

2. The water containment structure as recited in claim 1, wherein the flexible bladder consists of first and second flexible bladder tubes that are arranged alongside one another within the flexible sleeve and are formed to be filled with water, where each of said first and second flexible bladder tubes extend from an outer end of one flexible sleeve finger to an end of an opposite flexible sleeve outer end.

3. The water containment structure as recited in claim 2, wherein each of said fingers is sloped from the horizontal adjacent to a junction with a notch end to an outer end of said finger end at an angle that is from horizontal to vertical.

4. The water containment structure as recited in claim 1, wherein the flexible sleeve is formed from flat upper and lower sections of the lightweight puncture resistant flexible material that are secured together along their edges.

5. The water containment structure as recited in claim 1, wherein the flexible bladder is formed from a flexible polyethylene plastic, to be strong enough to resist punctures and has a range of wall thicknesses of from five (5) to twelve (12) millimeters.

6. The water containment structure as recited in claim 2, wherein, the flexible bladder air drains are mounted through the top surface of each of the first and second flexible bladder tube that are positioned in side by side relationship in the flexible sleeve and are each arranged to close when contacted by a level of water, and the air vents that are fitted into each said sleeve finger end are arranged to vent air from between each said first and second flexible bladder end and said sleeve finger end during water filling of said first and second flexible bladders.

7. A water containment structure comprising: a plurality of water containment structures that each include first and second flexible sleeves that are each formed from a lightweight, puncture resistant flexible material and each said first and second flexible sleeve is closed at opposite ends, and each said first and second flexible sleeves opposite ends include a U-shaped notch with sleeve fingers formed between ends of said U-shaped notch that extend at right angles outwardly from the ends of said U-shaped notch and said sleeve fingers are in parallel relationship to one another, and each sleeve finger is closed at an outer end thereof; a flexible bladder consisting of a pair of bladder tubes that are formed to fit within and fill each of said first and second flexible sleeves and the flexible sleeve fingers; a fill tube with a nozzle end for filling and draining water into and from each of said pair of bladder tubes, and each said fill tube fitted through a top surface of each said bladder tube and through a top surface of each of said pair of first and second flexible sleeves and which said fill tube also provide for venting air from within each of the flexible bladder tubes during their filling with water and an end of the sleeve fingers of each of said first and second flexible sleeves includes an air vent; and means for releasably connecting the fingers and the notches of each of said first and second flexible sleeves together, in end to end relationship, forming a continuous water containment structure consisting of a flexible lace means that is threaded through aligned holes formed through aligned edges of the fingers and the notches of each of said first and second flexible sleeves and ends of said flexible lace means are formed for connection together.

8. The water containment structure as recited in claim 7, wherein the ends of each of the fingers and notches of the first and second sleeves each include the holes formed; at equal spaced intervals; through inner and outer edges of said ends of the fingers and notches of the first and second flexible sleeves, and said holes are to align to receive the lace means, laced through said aligned holes, and ends of said lace include capped ends to facilitate their passage through said aligned holes and are connected together as by forming a bow therein or by knotting them together so as to prohibit said lace means from being drawn out from said aligned holes.

9. The water containment structure as recited in claim 8, further including fitting each of the holes with a metallic eyelet forming grommets.

10. The water containing structure as recited in claim 7, wherein the first and second flexible sleeves are each formed from upper and lower sections of a light weight puncture resistant flexible material that are secured together along edges of said upper and lower sections.

* * * * *